US010240481B2

(12) United States Patent
Scott et al.

(10) Patent No.: US 10,240,481 B2
(45) Date of Patent: Mar. 26, 2019

(54) ANGLED CUT TO DIRECT RADIATIVE HEAT LOAD

(71) Applicant: United Technologies Corporation, Hartford, CT (US)

(72) Inventors: Jonathan Ariel Scott, Southington, CT (US); Conway Chuong, Manchester, CT (US)

(73) Assignee: United Technologies Corporation, Farmington, CT (US)

( * ) Notice: Subject to any disclaimer, the term of this patent is extended or adjusted under 35 U.S.C. 154(b) by 827 days.

(21) Appl. No.: 14/758,267

(22) PCT Filed: Dec. 19, 2013

(86) PCT No.: PCT/US2013/076394

§ 371 (c)(1),
(2) Date: Jun. 29, 2015

(87) PCT Pub. No.: WO2014/105604

PCT Pub. Date: Jul. 3, 2014

(65) Prior Publication Data

US 2015/0337683 A1 Nov. 26, 2015

Related U.S. Application Data

(60) Provisional application No. 61/747,256, filed on Dec. 29, 2012.

(51) Int. Cl.

| | |
|---|---|
| ***F01D 9/06*** | (2006.01) |
| ***F01D 25/14*** | (2006.01) |
| ***F01D 25/24*** | (2006.01) |

(52) U.S. Cl.

CPC ..... *F01D 25/14* (2013.01); *F01D 9/065* (2013.01); *F01D 25/24* (2013.01); *F01D 25/243* (2013.01)

(58) Field of Classification Search

CPC ..... F01D 25/14; F01D 25/145; F01D 25/24; F01D 25/243; F01D 25/26; F01D 9/06;
(Continued)

(56) References Cited

U.S. PATENT DOCUMENTS

| | | | |
|---|---|---|---|
| 2,214,108 | A | 7/1938 | Grece |
| 3,576,328 | A | 4/1971 | Vase |

(Continued)

FOREIGN PATENT DOCUMENTS

| | | | |
|---|---|---|---|
| WO | WO 03/020469 | A1 | 3/2003 |
| WO | WO 2006/007686 | A1 | 1/2006 |

(Continued)

OTHER PUBLICATIONS

TEADIT, Metallic Materials, accessed Feb. 28, 2018, http://www.allsealsinc.com/teadit/TypicalMetalProperties.pdf, Stainless steels.*

(Continued)

*Primary Examiner* — Ninh H. Nguyen
*Assistant Examiner* — Wayne A Lambert
(74) *Attorney, Agent, or Firm* — Kinney & Lange, P.A.

(57) ABSTRACT

A fairing (118) comprises an inner platform (122), an outer platform (120), a plurality of vane bodies (124), and a flange (126). The inner and outer rings define radially inner and outer boundaries of an airflow path. The vane bodies extend radially from the inner platform to the outer platform. The flange extends radially outward from the outer platform, and is defined by a frustoconical surface (S) extending radially inward and axially aft from a substantially radial upstream surface.

14 Claims, 2 Drawing Sheets

(58) Field of Classification Search
CPC ..... F01D 9/065; F05D 2220/321; F05D 2220/3213; F05D 2220/3215; F05D 2240/14; F05D 2240/15; F05D 2260/231
See application file for complete search history.

(56) References Cited

U.S. PATENT DOCUMENTS 3,802,046 A 4/1974 Wachtell et al.
3,970,319 A 7/1976 Carroll et al.
4,009,569 A 3/1977 Kozlin
4,044,555 A 4/1977 McLoughlin et al.
4,079,587 A * 3/1978 Nordstrom ..... F01D 9/065 415/115
4,088,422 A 5/1978 Martin
4,114,248 A 9/1978 Smith et al.
4,190,397 A * 2/1980 Schilling ..... F01D 25/243 415/108
4,305,697 A 12/1981 Cohen et al.
4,321,007 A 3/1982 Dennison et al.
4,369,016 A 1/1983 Dennison
4,478,551 A 10/1984 Honeycutt, Jr. et al.
4,645,217 A 2/1987 Honeycutt, Jr. et al.
4,678,113 A 7/1987 Bridges et al.
4,738,453 A 4/1988 Ide
4,756,536 A 7/1988 Belcher
4,793,770 A 12/1988 Schonewald et al.
4,920,742 A 5/1990 Nash et al.
4,979,872 A * 12/1990 Myers ..... F01D 9/065 403/131
4,987,736 A 1/1991 Ciokajlo et al.
4,989,406 A 2/1991 Vdoviak et al.
4,993,918 A 2/1991 Myers et al.
5,031,922 A 7/1991 Heydrich
5,042,823 A 8/1991 Mackay et al.
5,071,138 A 12/1991 Mackay et al.
5,076,049 A 12/1991 VonBenken et al.
5,100,158 A 3/1992 Gardner
5,108,116 A 4/1992 Johnson et al.
5,115,642 A * 5/1992 Cvelbar ..... F23R 3/60 415/191
5,169,159 A 12/1992 Pope et al.
5,174,584 A 12/1992 Lahrman
5,188,507 A 2/1993 Sweeney
5,211,541 A 5/1993 Fledderjohn et al.
5,236,302 A 8/1993 Weisgerber et al.
5,246,295 A 9/1993 Ide
5,265,807 A 11/1993 Steckbeck et al.
5,269,057 A 12/1993 Mendham
5,272,869 A 12/1993 Dawson et al.
5,273,397 A 12/1993 Czachor et al.
5,292,227 A 3/1994 Czachor et al.
5,312,227 A 5/1994 Grateau et al.
5,338,154 A 8/1994 Meade et al.
5,357,744 A 10/1994 Czachor et al.
5,370,402 A 12/1994 Gardner et al.
5,385,409 A 1/1995 Ide
5,401,036 A 3/1995 Basu
5,438,756 A 8/1995 Halchak et al.
5,474,305 A 12/1995 Flower
5,483,792 A 1/1996 Czachor et al.
5,558,341 A 9/1996 McNickle et al.
5,597,286 A 1/1997 Dawson et al.
5,605,438 A 2/1997 Burdgick et al.
5,609,467 A 3/1997 Lenhart et al.
5,632,493 A 5/1997 Gardner
5,634,767 A 6/1997 Dawson
5,691,279 A 11/1997 Tauber et al.
5,755,445 A 5/1998 Arora
5,851,105 A 12/1998 Fric et al.
5,911,400 A 6/1999 Niethammer et al.
6,163,959 A 12/2000 Arraitz et al.
6,179,560 B1 1/2001 Kouris et al.
6,196,550 B1 3/2001 Arora et al.
6,227,800 B1 5/2001 Spring et al.
6,337,751 B1 1/2002 Kimizuka
6,343,912 B1 2/2002 Mangeiga et al.
6,358,001 B1 3/2002 Bosel et al.
6,364,316 B1 4/2002 Arora
6,439,841 B1 8/2002 Bosel
6,511,284 B2 1/2003 Darnell et al.
6,578,363 B2 6/2003 Hashimoto et al.
6,601,853 B2 8/2003 Inoue
6,612,807 B2 9/2003 Czachor
6,619,030 B1 9/2003 Seda et al.
6,638,013 B2 10/2003 Nguyen et al.
6,652,229 B2 11/2003 Lu
6,672,833 B2 1/2004 MacLean et al.
6,719,524 B2 4/2004 Nguyen et al.
6,736,401 B2 5/2004 Chung et al.
6,792,758 B2 9/2004 Dowman
6,796,765 B2 9/2004 Kosel et al.
6,805,356 B2 10/2004 Inoue
6,811,154 B2 11/2004 Proctor et al.
6,935,631 B2 8/2005 Inoue
6,969,826 B2 11/2005 Trewiler et al.
6,983,608 B2 1/2006 Allen, Jr. et al.
7,055,305 B2 6/2006 Baxter et al.
7,094,026 B2 8/2006 Coign et al.
7,100,358 B2 9/2006 Gekht et al.
7,200,933 B2 4/2007 Lundgren et al.
7,229,249 B2 6/2007 Durocher et al.
7,238,008 B2 7/2007 Bobo et al.
7,249,463 B2 * 7/2007 Anderson ..... F01D 25/243 415/112
7,367,567 B2 5/2008 Farah et al.
7,371,044 B2 5/2008 Nereim
7,389,583 B2 6/2008 Lundgren
7,614,150 B2 11/2009 Lundgren
7,631,879 B2 12/2009 Diantonio
7,673,461 B2 3/2010 Cameriano et al.
7,677,047 B2 3/2010 Somanath et al.
7,735,833 B2 6/2010 Braun et al.
7,798,768 B2 9/2010 Strain et al.
7,815,417 B2 10/2010 Somanath et al.
7,824,152 B2 11/2010 Morrison
7,891,165 B2 2/2011 Bader et al.
7,909,573 B2 3/2011 Cameriano et al.
7,955,446 B2 6/2011 Dierberger
7,959,409 B2 6/2011 Guo et al.
7,988,799 B2 8/2011 Dierberger
8,069,648 B2 12/2011 Snyder et al.
8,083,465 B2 12/2011 Herbst et al.
8,091,371 B2 1/2012 Durocher et al.
8,092,161 B2 1/2012 Cai et al.
8,099,962 B2 * 1/2012 Durocher ..... F01D 9/065 415/126
8,152,451 B2 4/2012 Manteiga et al.
8,162,593 B2 4/2012 Guimbard et al.
8,172,526 B2 5/2012 Lescure et al.
8,177,488 B2 5/2012 Manteiga et al.
8,221,071 B2 7/2012 Wojno et al.
8,245,399 B2 8/2012 Anantharaman et al.
8,245,518 B2 8/2012 Durocher et al.
8,282,342 B2 10/2012 Tonks et al.
8,371,127 B2 2/2013 Durocher et al.
8,371,812 B2 2/2013 Manteiga et al.
8,616,835 B2 * 12/2013 Hashimoto ..... F01D 9/065 415/142
8,863,531 B2 * 10/2014 Scott ..... F02C 7/18 415/115
9,316,153 B2 * 4/2016 Patat ..... F01D 9/02
2003/0025274 A1 2/2003 Allan et al.
2003/0042682 A1 3/2003 Inoue
2003/0062684 A1 4/2003 Inoue
2003/0062685 A1 4/2003 Inoue
2005/0046113 A1 3/2005 Inoue
2006/0010852 A1 1/2006 Gekht et al.
2008/0216300 A1 9/2008 Anderson et al.
2009/0053046 A1 * 2/2009 Black ..... F01D 25/26 415/173.1
2009/0155069 A1 6/2009 Durocher et al.
2010/0061846 A1 3/2010 Herbst et al.
2010/0132371 A1 6/2010 Durocher et al.
2010/0132374 A1 6/2010 Manteiga et al.

(56) References Cited

U.S. PATENT DOCUMENTS

| | | | | |
|---|---|---|---|---|
| 2010/0132377 | A1 | 6/2010 | Durocher et al. | |
| 2010/0202872 | A1 | 8/2010 | Weidmann | |
| 2010/0236244 | A1 | 9/2010 | Longardner | |
| 2010/0275572 | A1 | 11/2010 | Durocher et al. | |
| 2010/0275614 | A1 | 11/2010 | Fontaine et al. | |
| 2010/0303608 | A1* | 12/2010 | Kataoka | F01D 25/162 415/68 |
| 2010/0307165 | A1 | 12/2010 | Wong et al. | |
| 2011/0000223 | A1 | 1/2011 | Russberg | |
| 2011/0005234 | A1 | 1/2011 | Hashimoto et al. | |
| 2011/0061767 | A1 | 3/2011 | Vontell et al. | |
| 2011/0081237 | A1 | 4/2011 | Durocher et al. | |
| 2011/0081239 | A1 | 4/2011 | Durocher | |
| 2011/0081240 | A1 | 4/2011 | Durocher et al. | |
| 2011/0085895 | A1 | 4/2011 | Durocher et al. | |
| 2011/0214433 | A1 | 9/2011 | Feindel et al. | |
| 2011/0262277 | A1 | 10/2011 | Sjoqvist et al. | |
| 2011/0302929 | A1 | 12/2011 | Bruhwiler | |
| 2012/0111023 | A1 | 5/2012 | Sjoqvist et al. | |
| 2012/0156020 | A1 | 6/2012 | Kottilingam et al. | |
| 2012/0186254 | A1 | 7/2012 | Ito et al. | |
| 2012/0204569 | A1 | 8/2012 | Schubert | |
| 2013/0011242 | A1 | 1/2013 | Beeck et al. | |

FOREIGN PATENT DOCUMENTS

| | | | |
|---|---|---|---|
| WO | WO 2009/157817 | A1 | 12/2009 |
| WO | WO 2010/002295 | A1 | 1/2010 |
| WO | WO 2012/158070 | A1 | 11/2012 |

OTHER PUBLICATIONS

HPAlloys, High Temperature Alloys, accessed Feb. 28, 2018, https://www.hpalloy.com/Alloys/hightemperature.aspx, Hastelloy and Inconel.*

International Search Report and Written Opinion from PCT Application Serial No. PCT/US2013/076394, dated Apr. 14, 2014, 13 pages.

* cited by examiner

ANGLED CUT TO DIRECT RADIATIVE HEAT LOAD

BACKGROUND

The present disclosure relates generally to gas turbine engines, and more particularly to heat management in a turbine exhaust case of a gas turbine engine.

A turbine exhaust case is a structural frame that supports engine bearing loads while providing a gas path at or near the aft end of a gas turbine engine. Some aeroengines utilize a turbine exhaust case to help mount the gas turbine engine to an aircraft airframe. In industrial applications, a turbine exhaust case is more commonly used to couple gas turbine engines to a power turbine that powers an electrical generator. Industrial turbine exhaust cases can, for instance, be situated between a low pressure engine turbine and a generator power turbine. A turbine exhaust case must bear shaft loads from interior bearings, and must be capable of sustained operation at high temperatures.

Turbine exhaust cases serve two primary purposes: airflow channeling and structural support. Turbine exhaust cases typically comprise structures with inner and outer rings connected by radial struts. The struts and rings often define a core flow path from fore to aft, while simultaneously mechanically supporting shaft bearings situated axially inward of the inner ring. The components of a turbine exhaust case are exposed to very high temperatures along the core flow path. Various approaches and architectures have been employed to handle these high temperatures. Some turbine exhaust case frames utilize high-temperature, high-stress capable materials to both define the core flow path and bear mechanical loads. Other frame architectures separate these two functions, pairing a structural frame for mechanical loads with a high-temperature capable fairing to define the core flow path. Superalloys capable of operating in the high temperatures of the core flow path are commonly expensive and difficult to machine.

SUMMARY

The present disclosure is directed toward a fairing comprising an inner platform, an outer platform, a plurality of vane bodies, and a flange. The inner and outer platforms define radially inner and outer boundaries of an airflow path. The vane bodies extend radially from the inner platform to the outer ring. The flange extends radially outward from the outer platform, and is defined by a frustoconical surface extending radially inward and axially aft from a substantially radial upstream surface.

DETAILED DESCRIPTION

Figure 1:
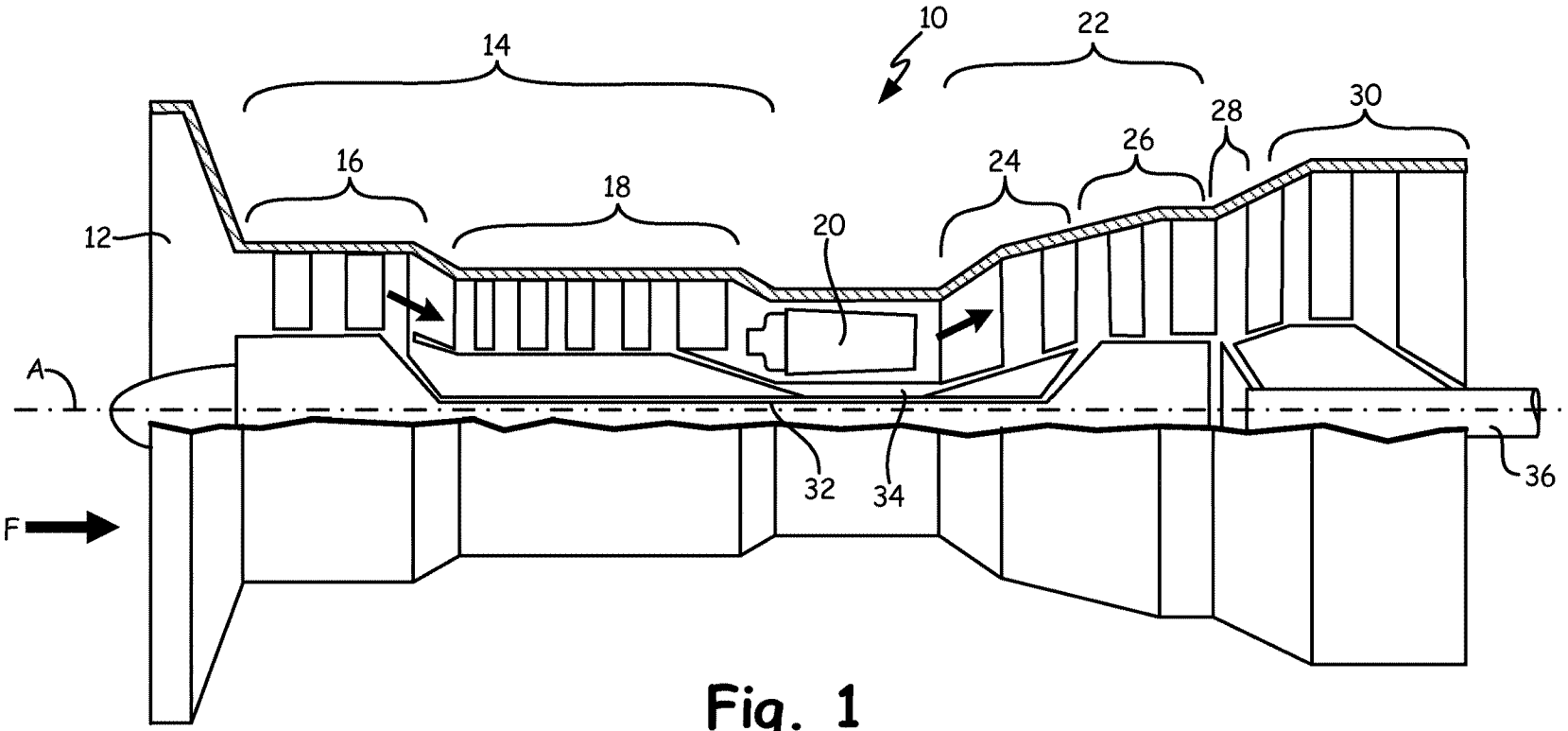
FIG. 1 is a simplified partial cross-sectional view of an embodiment of a gas turbine engine.

FIG. 1 is a simplified partial cross-sectional view of gas turbine engine 10, comprising inlet 12, compressor 14 (with low pressure compressor 16 and high pressure compressor 18), combustor 20, engine turbine 22 (with high pressure turbine 24 and low pressure turbine 26), turbine exhaust case 28, power turbine 30, low pressure shaft 32, high pressure shaft 34, and power shaft 36. Gas turbine engine 10 can, for instance, be an industrial power turbine.

Low pressure shaft 32, high pressure shaft 34, and power shaft 36 are situated along rotational axis A. In the depicted embodiment, low pressure shaft 32 and high pressure shaft 34 are arranged concentrically, while power shaft 36 is disposed axially aft of low pressure shaft 32 and high pressure shaft 34. Low pressure shaft 32 defines a low pressure spool including low pressure compressor 16 and low pressure turbine 26. High pressure shaft 34 analogously defines a high pressure spool including high pressure compressor 18 and high pressure compressor 24. As is well known in the art of gas turbines, airflow F is received at inlet 12, then pressurized by low pressure compressor 16 and high pressure compressor 18. Fuel is injected at combustor 20, where the resulting fuel-air mixture is ignited. Expanding combustion gasses rotate high pressure turbine 24 and low pressure turbine 26, thereby driving high and low pressure compressors 18 and 16 through high pressure shaft 34 and low pressure shaft 32, respectively. Although compressor 14 and engine turbine 22 are depicted as two-spool components with high and low sections on separate shafts, single spool or 3+ spool embodiments of compressor 14 and engine turbine 22 are also possible. Turbine exhaust case 28 carries airflow from low pressure turbine 26 to power turbine 30, where this airflow drives power shaft 36. Power shaft 36 can, for instance, drive an electrical generator, pump, mechanical gearbox, or other accessory (not shown).

In addition to defining an airflow path from low pressure turbine 26 to power turbine 30, turbine exhaust case 28 can support one or more shaft loads. Turbine exhaust case 28 can, for instance, support low pressure shaft 32 via bearing compartments (not shown) disposed to communicate load from low pressure shaft 32 to a structural frame of turbine exhaust case 28.

Figure 2:
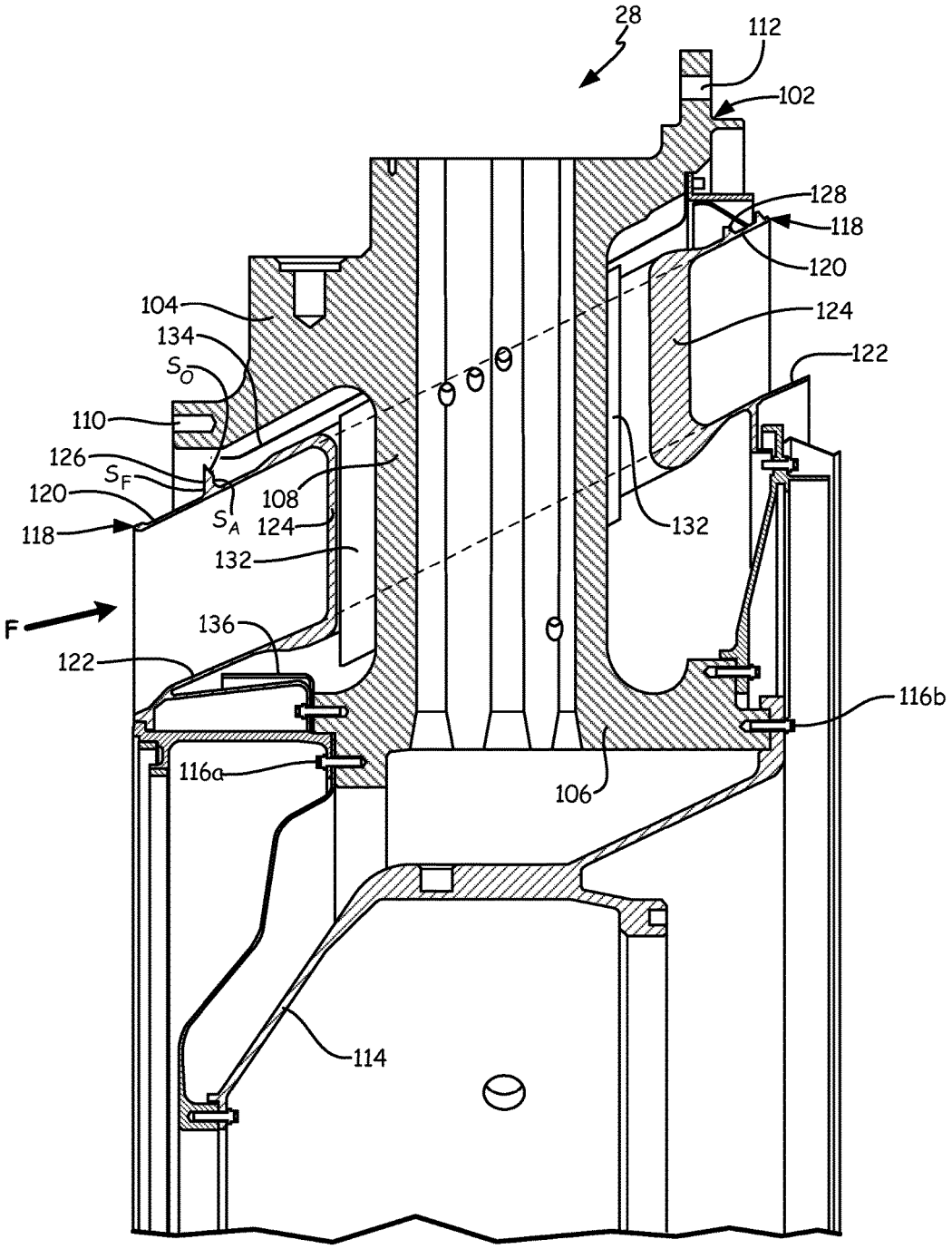
FIG. 2 is a cross-sectional view of a turbine exhaust case of the gas turbine engine of FIG. 1.

FIG. 2 is a cross-sectional view of an embodiment of turbine exhaust case 28, illustrating frame 102 (with frame outer ring 104, frame inner ring 106, frame struts 108, low pressure turbine connection 110, and power turbine connection 112), bearing support 114, fasteners 116*a* and 116*b*, fairing 118 (with fairing outer platform 120, fairing inner platform 122, and fairing vanes 124), forward stiffening flange 126, aft stiffening flange 128, strut heat shield 132, outer heat shield 134, and inner heat shield 136.

As described above with respect to FIG. 1, turbine exhaust case 28 defines at least a portion of an airflow path for core flow F, and carries load radially from bearing support 114 (which in turn connects to bearing components, not shown). These two functions are performed by separate components: frame 102 carries bearing loads, while fairing 118 at least partially defines the flow path of core flow F.

Frame 102 is a relatively thick, rigid support structure formed, for example, of cast steel. Outer ring 104 of frame 102 serves as an attachment point for upstream and downstream components at low pressure turbine connection 110 and power turbine connection 112, respectively. Low pressure turbine connection 110 and power turbine connection 112 can, for instance, include fastener holes for attachment to adjacent low pressure turbine 26 and power turbine 30, respectively. Frame inner ring 106 is mechanically connected to bearing support 114 via fasteners 116*a*, which can for instance be bolts, screws, pins or rivets. Frame inner ring 106 communicates bearing load radially from bearing support 114 to frame outer ring 104 via frame struts 108, which extend at angular intervals between frame inner ring 106 and frame outer ring 104. Although only one strut 108 is visible in FIG. 1, turbine exhaust case 28 can include any desired number of struts 108.

Fairing 118 is a high-temperature capable aerodynamic structure at least partially defining the boundaries of core flow F through turbine exhaust case 28. Fairing outer platform 120 generally defines an outer flowpath diameter, while fairing inner platform 122 generally defines an inner flowpath diameter. Fairing vanes 124 surround frame struts 108, and form a plurality of aerodynamic vane bodies. Fairing 118 can, for instance, be formed of a superalloy material such as Inconel or other nickel-based superalloy. Fairing 118 is generally rated for higher temperatures than frame 102, and can be affixed to frame 102 via fasteners 116*b*. In the depicted embodiment, fairing 118 is affixed to frame inner ring 106 at the forward inner diameter of fairing 118, although alternative embodiments of turbine exhaust case 28 can secure fairing 118 by other means and/or in other locations. Forward and aft stiffening flanges 126 and 128, respectively, can extend radially outward from the entire circumference of fairing outer platform 120 to provide increased structural rigidity to fairing 118.

Turbine exhaust case 28 includes a plurality of heat shields to protect frame 102 from radiative and convective heating. Strut heat shield 132 is situated between fairing vanes 124 and frame struts 108. Outer heat shield 134 can be situated between fairing outer platform 120 and frame outer ring 104. Inner heat shield 136 can be is situated radially inward of a forward portion of fairing inner platform 122. Like fairing 118, all three heat shields 132, 134, and 136 can be formed of Inconel or a similar nickel-based superalloy. Strut heat shield 132, outer heat shield 134, and inner heat shield 136 act as barriers to heat from fairing 118, which can become very hot during operation of gas turbine 10. Heat shields 132, 134, and 136 thus help to protect frame 102, which can be rated to lower temperatures than fairing 118, from exposure to excessive heat.

During engine operation, core airflow convectively heats fairing 118, which in turn conductively heats stiffening flange 126. Angled cut S defines angled cut surface $S_O$, a frustoconical outer surface extending radially inward and axially aft from substantially radial forward surface $S_F$ of forward stiffening flange 126. In the depicted embodiment, angled cut surface $S_O$ is a chamfer that extends axially to substantially radial aft flange surface $S_A$. In alternative embodiments, angled cut surface $S_O$ can extend to fairing outer platform 120. Angled cut surface $S_O$ radiates primarily in a direction normal to cut surface $S_O$, i.e. towards outer heat shield 134, thereby reducing radiative heating of frame 102. Angled cut S thus enables cooler operation of frame 102 by minimizing the radiative heat load on frame 102 from stiffening flange 126.

DISCUSSION OF POSSIBLE EMBODIMENTS

The following are non-exclusive descriptions of possible embodiments of the present invention.

A fairing comprising an inner platform, an outer platform, a plurality of vane bodies, and a flange. The inner and outer platforms define radially inner and outer boundaries, respectively, of an airflow path. Each of the plurality of vane bodies extends radially from the inner platform to the outer platform. The flange extends radially outward from the inner platform, and is defined by a frustoconical surface extending radially inward and axially aft from a substantially radial upstream surface.

The fairing of the preceding paragraph can optionally include, additionally and/or alternatively, any one or more of the following features, configurations, and/or additional components:

wherein the fairing is formed of a nickel-based superalloy.

wherein the fairing further comprises a second flange extending radially outward from the outer platform at a location axially aft of the first flange.

wherein the second flange is aft of the vane bodies and the first flange is forward of the vane bodies.

wherein the frustoconical surface extends radially inward and axially aft to a substantially radial aft surface.

A turbine exhaust case comprising a frame and a fairing. The frame has inner and outer rings connected by a plurality of radial struts. The fairing is situated between the inner and outer rings to define an airflow path, and comprises an inner platform, an outer platform, a plurality of vane bodies, and a stiffening flange. The inner platform is situated radially inward of the inner ring. The outer platform is situated radially inward of the outer ring. Each of the plurality of vane bodies extends from the inner platform to the outer platform, and surrounds a radial strut. The stiffening flange extends radially outward from the outer platform, and is defined by a frustoconical surface extending radially inward and axially aft from a substantially radial upstream surface.

The turbine exhaust case of the preceding paragraph can optionally include, additionally and/or alternatively, any one or more of the following features, configurations, and/or additional components:

a radiative heat shield disposed between the fairing and the frame, such that the radiative heat shield and the fairing together define a secondary airflow path that the radially outermost surface of the stiffening flange directs away from the frame.

wherein the radiative heat shield comprises an outer heat shield and a strut heat shield, and wherein the secondary airflow path flows between the outer heat shield and the outer platform of the heat shield.

wherein the fairing and the radiative heat shield are formed of a nickel-based superalloy, wherein the frame is formed of cast steel.

wherein the frame is rated to a lower temperature than the fairing.

wherein the airflow path carries core airflow from a low pressure turbine immediately forward of the turbine exhaust case to power turbine immediately aft of the turbine exhaust case.

A method of protecting a turbine exhaust case frame from overheating. The method comprises defining a core airflow path through the turbine exhaust case frame with a fairing having at least one radially-extending stiffening flange, situating a radiative heat shield between the fairing and the turbine exhaust case such that the radiative heat shield and the fairing together define a secondary airflow path, and directing hot air from the secondary airflow path away from the turbine exhaust case frame via a frustoconical surface of the stiffening flange extending radially inward and axially aft from a radial upstream surface of the stiffening flange.

The method of the preceding paragraph can optionally include, additionally and/or alternatively, any one or more of the following features, configurations, and/or additional components:

wherein the radiative heat shield and the fairing are formed of a nickel-based superalloy.

wherein the turbine exhaust case frame is formed of steel.

While the invention has been described with reference to an exemplary embodiment(s), it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fairing comprising:

an inner platform defining a radially inner boundary of an airflow path;

an outer platform defining a radially outer boundary of the airflow path;

a plurality of vane bodies extending radially from the inner platform to the outer platform; and a first flange extending radially outward from the outer platform, and defined by a substantially radial upstream facing surface and a frustoconical surface extending radially inward and axially aft from the substantially radial upstream facing surface and facing radially outward.

2. The fairing of claim 1, wherein the fairing is formed of a nickel-based superalloy.

3. The fairing of claim 1, wherein the fairing further comprises a second flange extending radially outward from the outer platform at a location axially aft of the first flange.

4. The fairing of claim 3, wherein the second flange is aft of the vane bodies and the first flange is forward of the vane bodies.

5. The fairing of claim 1, wherein the frustoconical surface extends radially inward and axially aft to a substantially radial aft surface.

6. A turbine exhaust case comprising:

a frame having inner and outer rings connected by a plurality of radial struts; and a fairing situated between the inner and outer rings to define an airflow path, the fairing comprising:

an inner platform situated radially outward of the inner ring;

an outer platform situated radially inward of the outer ring;

a plurality of vane bodies extending from the inner platform to the outer platform and surrounding the radial struts;

a radiative heat shield disposed between the fairing and the frame and comprising an outer radiative heat shield disposed between the outer platform and the outer ring; and a stiffening flange extending radially outward from the outer platform, and defined by a substantially radial upstream facing surface and a frustoconical surface extending radially inward and axially aft from the substantially radial upstream facing surface, facing radially outward and angled toward the outer radiative heat shield such that radiation from the frustoconical surface primarily heats the radiative heat shield, rather than the frame.

7. The turbine exhaust case of claim 6, wherein the radiative heat shield further comprises a strut heat shield disposed between the vane bodies and the radial struts.

8. The turbine exhaust case of claim 6, wherein the fairing and the radiative heat shield are formed of a nickel-based superalloy.

9. The turbine exhaust case of claim 6, wherein the frame is formed of steel.

10. The turbine exhaust case of claim 6, wherein the frame is rated to a lower temperature than the fairing.

11. The turbine exhaust case of claim 6, wherein the airflow path carries core airflow from a low pressure turbine immediately forward of the turbine exhaust case to power turbine immediately aft of the turbine exhaust case.

12. A method of protecting a turbine exhaust case frame from overheating, the method comprising:

defining a core airflow path through the turbine exhaust case frame with a fairing having at least one radially-extending stiffening flange defined by a substantially radial upstream facing surface and a frustoconical surface extending radially inward and axially aft from the substantially radial upstream facing surface and facing radially outward;

situating a radiative heat shield between the fairing and the turbine exhaust case, and directing radiation from the radially-extending stiffening flange towards the radiative heat shield and away from the turbine exhaust case frame via the frustoconical surface of the stiffening flange, wherein the frustoconical surface is angled toward the radiative heat shield.

13. The method of claim 12, wherein the radiative heat shield and the fairing are formed of a nickel-based superalloy.

14. The method of claim 12, wherein the turbine exhaust case frame is formed of steel.

* * * * *